US005934042A

United States Patent [19]

Peronek

[11] Patent Number: 5,934,042

[45] Date of Patent: Aug. 10, 1999

[54] ANTI-ROTATION WEAR PLATE FOR CAPPING MACHINE

[75] Inventor: Michael H. Peronek, Strongsville, Ohio

[73] Assignee: FCI, Inc., Cleveland, Ohio

[21] Appl. No.: 09/002,784

[22] Filed: Jan. 5, 1998

[51] Int. Cl.[6] ..... B65B 7/28

[52] U.S. Cl. ..... 53/317; 53/331.5; 53/367

[58] Field of Search ..... 53/317, 331.5, 53/367

[56] References Cited

U.S. PATENT DOCUMENTS

| | | | |
|---|---|---|---|
| 3,812,646 | 5/1974 | Baldyga et al. | 53/329 X |
| 3,831,344 | 8/1974 | Over | 53/329 |
| 4,120,135 | 10/1978 | Baldyga | 53/367 X |
| 4,143,754 | 3/1979 | Eldred | 198/379 |
| 4,280,612 | 7/1981 | Nagano | 198/379 |
| 4,765,119 | 8/1988 | Aidlin et al. | 53/317 X |
| 4,939,890 | 7/1990 | Peronek . | |
| 4,950,350 | 8/1990 | Zodrow et al. | 198/379 X |
| 5,224,586 | 7/1993 | Naka et al. | 198/379 X |
| 5,398,485 | 3/1995 | Osifchin | 53/317 X |
| 5,826,400 | 10/1998 | Martin et al. | 53/367 |

*Primary Examiner*—Daniel B. Moon
*Attorney, Agent, or Firm*—Vickers, Daniels & Young

[57] ABSTRACT

A wear plate for use in a rotary capping machine used to apply caps onto the upper threaded neck of a series of plastic containers, having a generally cylindrical body with an outer cylindrical periphery with a diameter and a pedaloid base with spaced pads separated by radial recesses extending from a center recess, as the containers are moved along a circular path by a star wheel with outwardly protruding pockets supporting the necks of the containers. The wear plate being a flat ring rotated in unison with the star wheel about a machine axis and adapted to support the containers, the ring having an upwardly facing flat surface and a series of container receiving nests movable in the circular path as the ring is rotated, each of the nests having an inner flat area and at least one elongated bar-like abutment projecting upwardly from the flat surface a given vertical distance and extending in a direction radial of the inner area.

33 Claims, 7 Drawing Sheets

ANTI-ROTATION WEAR PLATE FOR CAPPING MACHINE

The present invention relates to the art of capping plastic bottles or containers as they are moved along a preselected path and more particularly to a wear plate in a capping machine which prevents rotation of the plastic bottle while a cap is being tightened onto the neck of the bottle.

The invention is particularly applicable to assembly of a plastic cap onto a plastic bottle of the type having a pedaloid base constituting a plurality of protruding pads separated by diverging recesses or crevices. However the invention has much broader applications and can be used in applying a cap onto a bottle which has various protrusions on its base.

INCORPORATION BY REFERENCE

Peronek U.S. Pat. No. 4,939,890 describes a capping machine of the type to which the present invention is directed, together with a description of several arrangements used in the art for preventing rotation of the bottle as it is being capped during its rotary movement by a star wheel. This patent is incorporated by reference herein as background information to explain certain prior anti-rotation arrangements of which the present invention is a specific improvement. Consequently, the details of the capping machine of the type to which the present invention is directed need not be explained.

BACKGROUND OF INVENTION

A capping machine or conventional capping apparatus includes a star wheel rotatable about a machine axis and having a plurality of outwardly opening pockets adapted to receive bottles fed in an assembly line fashion to the star wheel. Overlying the rotating star wheel is a plurality of individual capper heads for use in applying a cap to the upper threaded neck of a plastic bottle carried by the star wheel in an arcuate or circular path centered about the machine axis. A turret rotates the star wheel and capping heads in synchronism about the machine axis with an individual capping head located directly above each bottle receiving pocket on the star wheel. The capper heads employ a clutch mechanism whereby the head carrying a cap is rotated and driven axially downwardly at a predetermined force and torque limiting value to tighten the cap onto the bottle neck. In accordance with standard practice, an entrant guide mechanism or conveyor is mated with the capper star wheel to feed filled bottles to an entry point on or end of the path of movement of the capper star wheel. An exit guide mechanism or conveyor is similarly mated to the capper star wheel to transfer the capped bottles from an exit point on or end of the rotating capper star wheel. A stationary rear guide plate extends generally between the entry and exit points on the capping machine and is spaced radially outwardly from the pockets of the star wheel and functions to retain the bottles in the pockets as the star wheel rotates in unison with the capping heads. Below the bottles or containers is a segmented ring, known as a wear plate, rotated with the star wheel onto which the bottles or containers rest during capping. This is a conventional capping machine employed in bottling plants and is the mechanism to which the present invention is directed.

During the capping operation, it is necessary to assure that the bottle does not spin as the cap is tightened. A spinning action during the capping procedure can cause damage to the plastic container and reduce the desired tightness of the cap being applied automatically to the bottle as it is translated in a path determined by the star wheel. In the past, certain cap designs required a relatively high downward force during the capping operation. When this occurs, spinning of the bottle is prevented by frictional contact with the pocket, with the rear guide plate or with both of these structures. As the downward force during the capping operation has been reduced due to the design and functional characteristics of the cap being applied, friction at the neck of the bottles has been increased either by the use of upwardly directed knife ridges provided in the anti-spin segment on the top of the individual star wheel pockets. This structure is disclosed in Peronek U.S. Pat. No. 4,939,890. The knife ridges on the anti-spin segment on each pocket engage the lower surface of a circular flange at the bottom of the threaded neck of a plastic bottle to prevent rotation of the plastic bottle. This type of mechanism was not as effective as the downward force used in the capping operation was decreased due to the changes in design of the cap being applied. For that reason, the anti-rotation or anti-spin device of Peronek U.S. Pat. No. 4,939,890 has become the standard in the trade to prevent rotation of plastic bottles as they are being capped with relatively low downward force. This patent teaches a mechanism for externally applying a downward force on the body of a bottle being capped, which force is independent of the downward force created by the capping operation. This anti-spin or anti-rotation mechanism has been successful; however, it requires a mechanism for exerting a downward force on the bottle which is expensive and is dependent upon certain structural characteristics at the upper portion of the bottle itself. Changes in bottle configuration often require a new force exerting mechanism.

The anti-rotation device of Peronek U.S. Pat. No. 4,939,890 is a successful arrangement for applying plastic threaded safety caps onto the top of plastic bottles where the caps do not require heat to set or position the lower lock band around the neck of the bottle. The lock band of the cap simply snaps into a locking position when the capping head threads the cap onto the upper threaded neck of the plastic bottle. In this type of capping operation, the capper head exerts a downward force of between 15–20 pounds. This low axial force makes retention of the bottle from rotation within the star wheel pocket very difficult. This situation motivated the development and use of the anti-rotation feature disclosed and claimed in Peronek U.S. Pat. No. 4,939,890. The present invention relates to an anti-rotation mechanism to be used on a capping machine, which accomplishes the results of the Peronek anti-rotation arrangement, but does not rely upon developing downward frictional force on the top of the bottle during the capping operation. This concept has been attempted by separating the wear plate from the turret rotating the star wheel so the plate is a fixed arcuate plate under the capping heads onto which a fixed arcuate rib is mounted to engage the bottoms of the bottles as they slide along the plate. This mechanism requires modification of the capping machine and is costly to retrofit.

In accordance with the present invention, there is provided a device or method for preventing rotation of a plastic container, or bottle, of the type having a generally cylindrical body with a circular flange below a threaded neck on the top of the bottle. The invention is particularly applicable for use with a plastic bottle having a pedaloid base, which is somewhat standard in the soft drink industry. These bases include a plurality of downwardly extending pads, generally four or five pads, separated by diverging recesses. In the past, plastic bottles with pedaloid bases have been capped in a standard machine with a lower plate rotated with the capping heads and having contoured recesses or nests directly aligned with the capping heads and pockets of the rotating star wheel. In this prior art arrangement, a plurality of specially contoured recesses that match the pedaloid base configuration are used to receive the bases of the bottles as the bottles are moved by the star wheel. Since the bottles rest upon the lower circular wear plate or ring and are held within a contoured nest on the plate, rotation of the bottles is prevented by an interference between the lower wear plate and the bottom, or base, of the bottle. This arrangement is completely different from the concept of increasing the friction at the top of the bottle or otherwise preventing rotation of the bottle by frictional force. Such structure is now being sold by AMCO Products Company under the trademark Peta Drive. The circular wear plate of this system includes a plurality of upwardly facing recesses, each matching the lower pedaloid base of the bottles. The bottles rest on the lower wear plate as it rotates with the star wheel. Physical interference prevents rotation of the individual bottles. Provision of a lower circular wear plate with machined recesses, each matching the contour of a pedaloid base of the plastic bottles, is quite expensive. Each of the contoured recesses must be specially produced and accurately matched with respect to the actual shape of each pedaloid base of the bottle being processed. Consequently, each bottle required its own lower support wear plate. Indeed, when the filled bottles being capped are changed from a four pad pedaloid base to a five pad pedaloid base, a completely new, specially machined plate for supporting the pedaloid bases must be assembled onto the machine. This arrangement for providing a plate rotatable with the star wheel for supporting the lower pedaloid bases of the bottles demands a plate which must be accurately machined for use with specific star wheels.

Another anti-rotation system includes arrangement for fixing the support member or wear plate in a position spaced from the turret where the containers slide along a rib as the container is moved around the arcuate path dictated by the movement of capping head and the star wheel. The rib extends into the lower recess of the pedaloid base of the individual bottle to prevent rotation of the bottle or container as the capping head drives the cap onto the upper threaded neck of the bottle. By using this construction, a lower support plate carrying the upstanding rib is fixed and does not rotate with the star wheel. The upwardly extending rib prevents rotation of the bottles during the capping operation. This use of a fixed rib constitutes an improvement over other arrangements for using a lower plate with specially contoured recesses to provide interference against rotation of the bottle by the capping head; however, it requires a modification of the capping machine and is expensive to retrofit.

THE INVENTION

In accordance with the present invention, there is provided a standard wear plate of the type rotating with the star wheel of a rotary capping machine and adapted to accommodate cylindrical containers with an outer cylindrical periphery and a pedaloid base with spaced pads separated by radial recesses extending from a center recess of the base. In the capping machine, the containers are moved along a circular path by a star wheel that has outwardly protruding pockets supporting the necks of the containers or bottles while they are supported at the lower position by a rotating wear plate. The wear plate is a flat ring rotated in unison with the star wheel about the machine axis so the containers moving along a given circular path are carried by and supported on the wear plate. The ring constituting the wear plate has an upwardly facing flat surface with a series of container receiving nests movable along the circular path as the ring is rotated by the turret of the capping machine. Each of these nests has an inner area constituting a flat surface and at least one elongated bar-like abutment projecting upwardly from the flat surface of the ring a given vertical distance and extending in a direction radial of the inner area of the nests. In practice, two or three of the elongated bar-like abutments project radially outwardly from the inner area defining the nest onto which a container is supported. These radially projecting abutments are faced by an angle defined as 360°/X, wherein X is a number of pads in the pedaloid base. The normal plastic container to which the invention is specifically directed has five pads; therefore, the three bar-like abutments are spaced 72°. In accordance with an aspect of the invention, the outer periphery of the rotating ring constituting the wear plate is inward of the outermost portion of the bottles, or containers, being moved along the circular path and carried by the wear plate. Thus, an inlet conveyor with a plate having a vertical height with respect to the wear plate generally greater than the height of the abutments can direct the bottles or containers onto the wear plate above the abutments. Thus, the bottle drops onto the radially extending abutments. As soon as the capping action commences, the pads move downwardly over the abutments locking a container from rotation as it is moved by the star wheel and wear plate toward the exit end of the capping machine. At the exit end, an outlet conveyor with a lift plate or ramp having a first end below the flat surface of the wear plate and a second end above the surface a distance greater than the height of the abutments engages the bottles and progressively moves them upwardly from their captured position in the nest. In this manner, as the capping machine rotates the wear plate with the upwardly extending abutments, bottles or containers are fed above the abutments and dropped into the nest. Thereafter, the capping operation takes place as the bottles are moved by the capping machine around the circular path. The upwardly extending abutments prevent rotation of the containers without putting stress at the neck of the container. At the exit end, the conveyor ramp lifts the bottles and directs the capped bottles or containers to the outlet stage of the capping line.

The primary object of the present invention is the provision of an anti-rotation wear plate for use in a standard capping machine, which wear plate prevents rotation of the plastic bottles or containers being capped by engaging a structural characteristic on the bottom of the bottle as it moves through the capping machine.

Another object of the present invention is the provision of a wear plate as defined above, which wear plate has an upper generally flat surface with one or more protruding elongated abutments so the bottle can be moved with the wear plate without rotation.

Another object of the present invention is the provision of a wear plate as defined above, which wear plate includes structural items which define individual nests for the bottle, where the items are simple rod-like elements that do not require machining of complex shapes to form nests on the wear plate.

Yet another object of the invention is the provision of an anti-rotation wear plate that merely replaces the standard wear plate of a capping machine to allow ease of retrofitting.

These and other objects and advantages will become apparent from the following description taken together with the accompanying drawings in which.

PREFERRED EMBODIMENT

Figure 1:
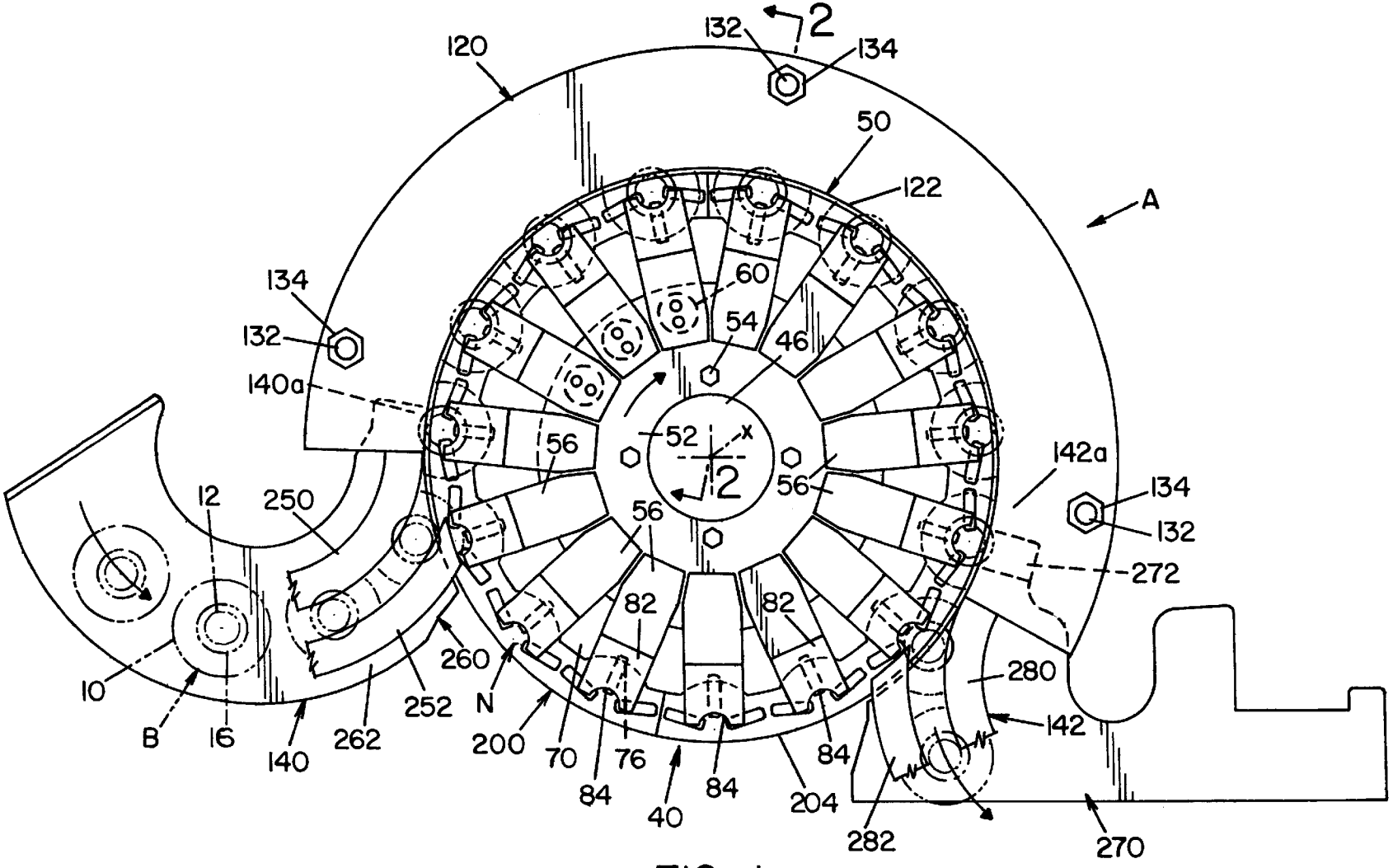
FIG. 1 is a top plan view of a standard bottle capping machine employing the preferred embodiment of the present invention.
Figure 2:
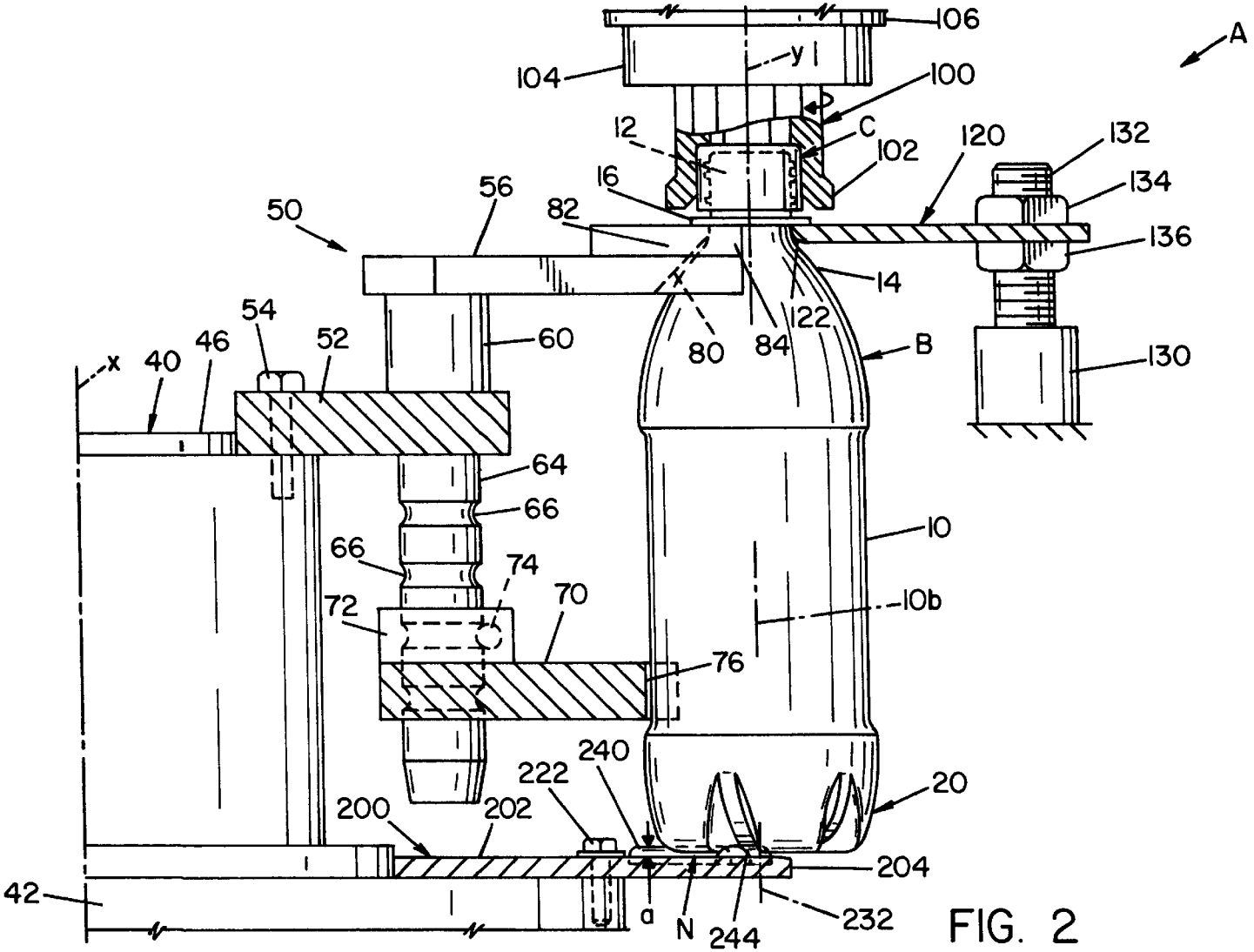
FIG. 2 is an enlarged cross-sectional view, taken generally along line 2—2 of FIG. 1.
Figure 3:
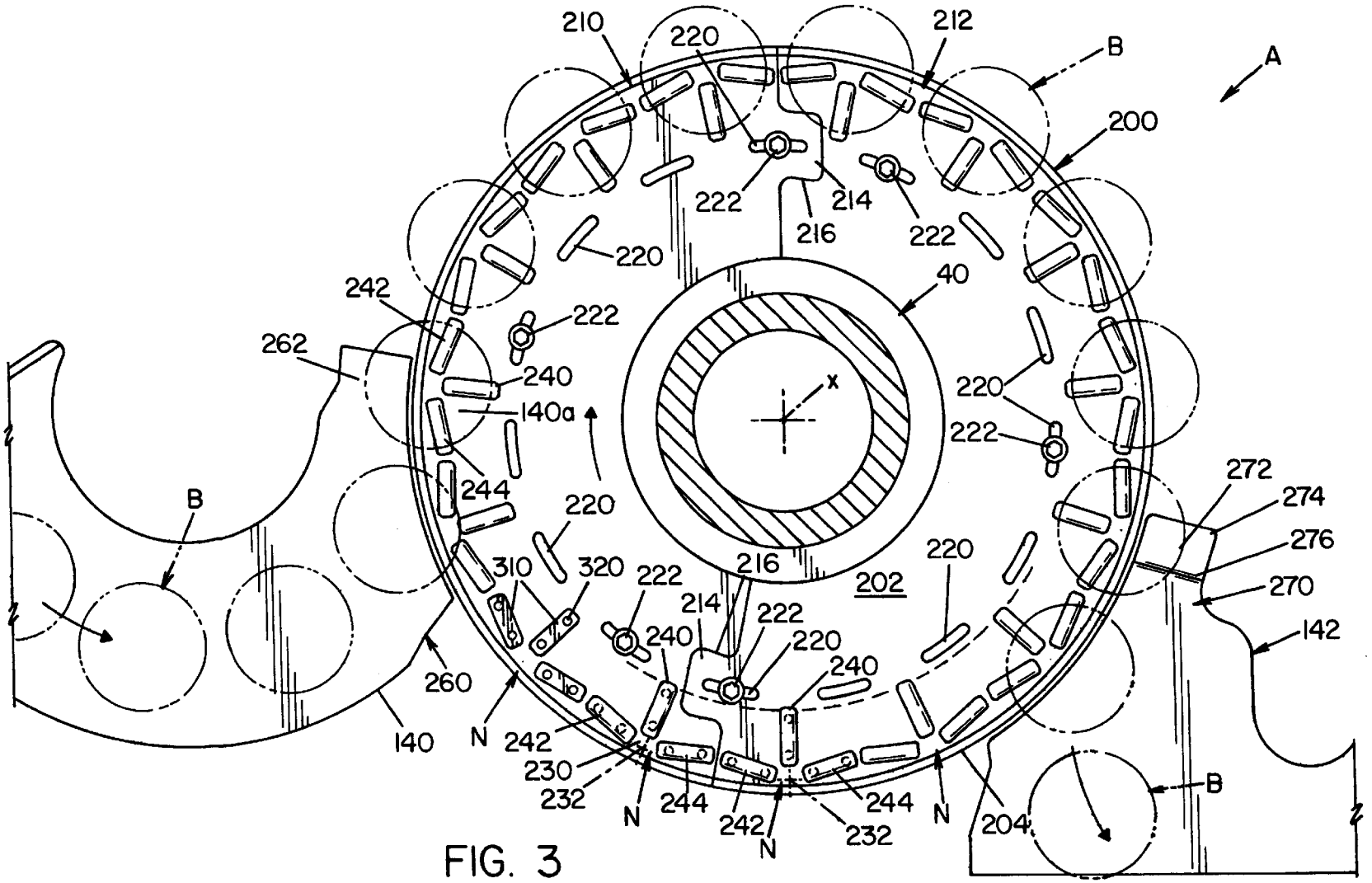
FIG. 3 is a top plan view of the wear plate constructed in accordance with the present invention.
Figure 6:
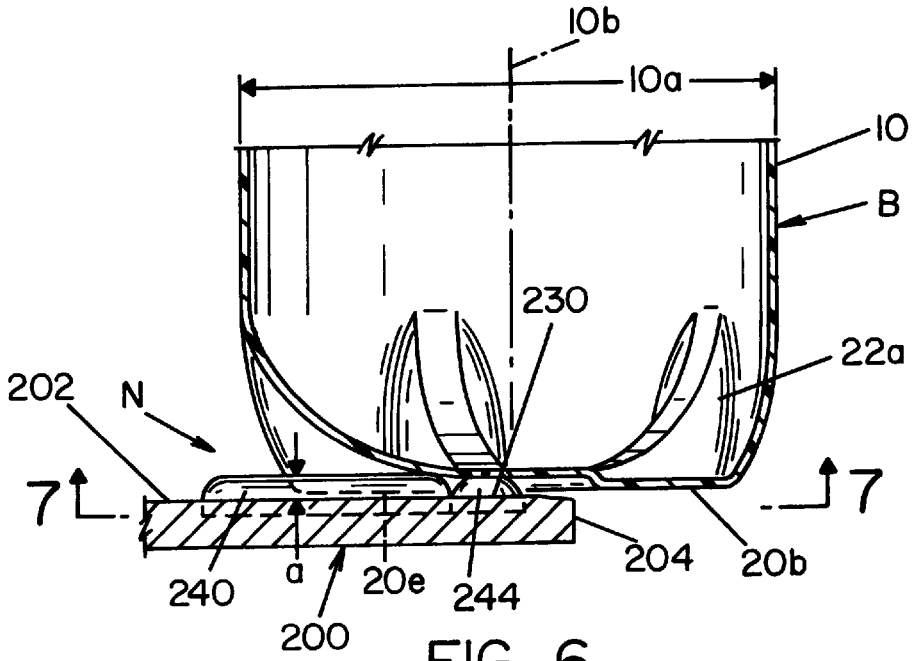
FIG. 6 is an enlarged view taken generally along line 6—6 of FIG. 4, and illustrating the bottom portion of the pedaloid based plastic bottle.
Figure 7:
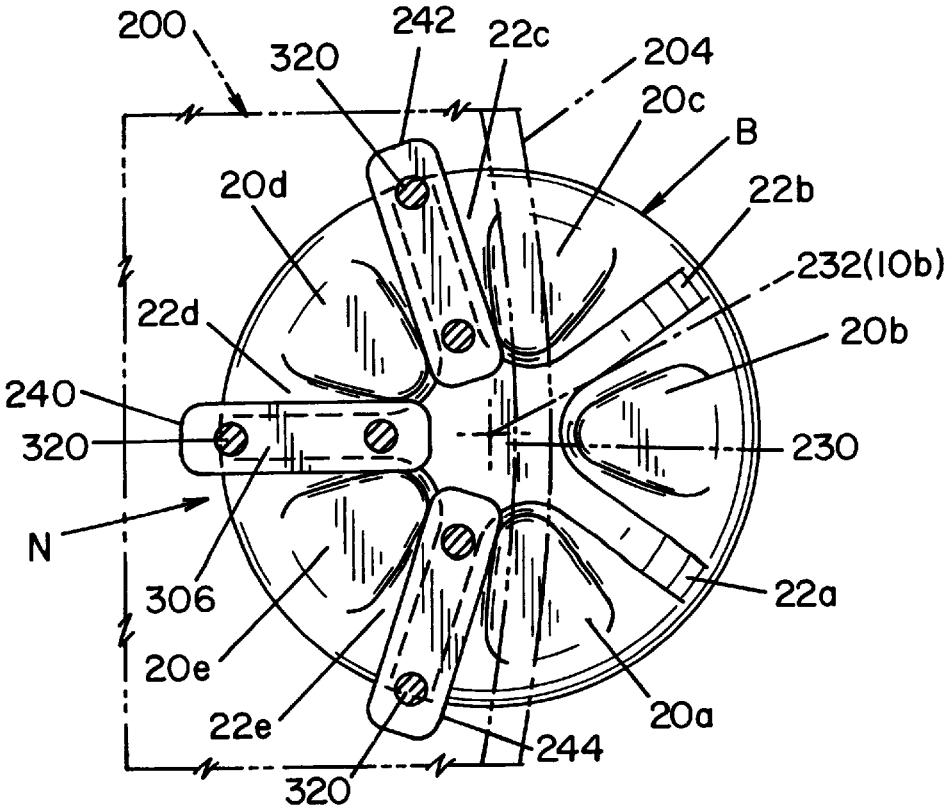
FIG. 7 is a cross-sectional view taken generally along line 7—7 of FIG. 6.

Referring now to the drawings wherein the showings are for the purpose of illustrating a preferred embodiment of the invention only and not for the purpose of limiting same, FIGS. 1–3 illustrate a somewhat standard capping machine A of the type used in capping a plastic PET bottle B having various sizes and lengths. In accordance with the illustrated embodiment, bottle or container B includes a generally cylindrical body 10 having diameter 10*a*, center 10*b* and an upper threaded neck 12 connected to the body by diverging top portion 14 and provided with a circular flange 16. The base of container or bottle B is a pedaloid base 20, which is quite common in the plastic container industry for use with soft drinks and bottled beverages and is best shown in FIGS. 2, 6 and 7. A pedaloid base is a base with a number of distinct downwardly extending pads with flat surfaces divided by generally diverging recesses. In the illustrated embodiment, pedaloid base 20 includes five pads 20*a*–20*e* separated by five diverging recesses 22*a*–22*e* best shown in FIGS. 6 and 7. Each pad has a generally lower flat support surface. This type of bottom structure gives rigidity and stability to a relatively thin bottle B formed by a standard plastic blow molding process. Onto the upper neck 12 machine A applies a plastic threaded cap C in accordance with standard procedure.

Capping machine A includes a central turret 40 rotatable about machine axis x and supported on lower base 42. In the illustration, turret 40 includes a centering extension 46 for receiving standard star wheel 50 supported by a two piece ring 52 bolted by bolts 54 around extension 46 and fixed onto turret 40. The star wheel includes a plurality of outwardly projecting arms 56 supported by posts 60 onto ring 52. A plurality of downwardly projecting pegs 64 extend below posts 60. These downwardly extending pegs 64 on each arm 56 have a plurality of axially spaced adjustable grooves 66, which are adapted to receive a bottle stabilizer ring 70 by way of a mounting housings 72 that are movable axially along posts 64 by retracted spring bias pin 74 in accordance with standard practice. The outward most end of stabilizer ring 70 includes arcuate recesses 76 adapted to engage and stabilize the body 10 of bottle B. In practice, when using the present invention, it may be possible to dispense with the use of stabilizer ring 70. A stabilizer structure can be individual members supported on posts 64; however, in the illustrated embodiment the stabilizer ring 70 having a plurality of circumferentially spaced arcuate recesses 76, best shown in FIG. 2. Arms 56 each include an arcuate nesting pocket 80 with an arcuate outer edge and adapted to receive an upper anti-spin insert 82 also having an arcuate edge or end 84. The upper surface of insert 82 can be modified or roughened to prevent rotation by frictional engagement with the under surface of flange 16; however, this feature is generally not used with the present invention, since spinning on such modifications will cause scuffing of the plastic forming the under surface of flange 16.

Capping machine A also includes a plurality of capping heads 100 rotated about machine axis x in unison with star wheel 50 by turret 40. Each capping head is located above a pocket 80 of star wheel 50 and includes a collet 102 driven by a standard clutch 104 through a drive unit 106, as shown in FIG. 2. As bottles B move in an arcuate path shown in FIG. 1, the capping head with a cap C in collet 102 is movable downwardly along capping axis y concentric with a bottle or container B held in pocket 80. The cap is then rotated until clutch 104 experiences a proper amount of torque. At that instance, collet 102 is moved upwardly leaving capped bottle B for further movement through machine A. In accordance with standard practice, a fixed guide plate 120 is positioned diametrically opposite pockets 80 of star wheel 50 and includes an arcuately shaped guide surface or edge 122 having a center of curvature corresponding generally with machine axis x. Plate 120 is spaced outwardly from star wheel 50 a distance necessary to allow guide surface or edge 122 to hold bottles B in pockets 80 as they are moved in a circular path by rotation of star wheel 50 by turret 40 and in unison with the matching capping heads 100. To fixedly locate surface or edge 122 of plate 120 in the proper position with respect to the rotating bottles B, support shafts 130 are provided with upwardly extending threaded portions 132. Lock bolts 134, 136 clamp fixed guide plate or back plate 120 with respect to the rotating bottles B in accordance with standard practice. Shafts 130 are mounted onto the fixed frame of the capping machine and are spaced circumferentially around machine A at the positions illustrated in FIG. 1. As shown in this Figure, an entrant guide mechanism or conveyor 140 directs filled bottles B to capping machine A at an entrant end or point 140*a*. In a like manner, exit guide mechanism or conveyor 142 removes capped bottles B from machine A at an exit end or point 142*a* so the bottle moves to the exit portion of the bottling line.

In operation, filled bottles B are moved in an assembly line fashion through entrant guide mechanism 140 to capping machine A at point 140*a*. The bottles are then engaged by nesting pocket 80 of star wheel 56 and are held in this position by fixed guide plate 120. As turret 40 rotates in the direction indicated by the arrow in FIG. 1 and the arrow in FIG. 2, bottles B move in an arcuate path after the bottle has been captured by machine A. A capping head moving in unison with a pocket 80 and having a cap C in collet 102 starts the capping process by rotating cap C over threaded neck 12 above circular flange 16 of bottle B. As the bottle is restrained from rotational, it is moved by turret 40 around machine A. The capping head finalizes the capping operation and is withdrawn from bottle B before the bottle reaches exit guide mechanism or conveyor 142 at point 142*a*. Inserts 82 with recesses 84 engage the bottles at the lower surface of flanges 16. In the past, the upper surface of these inserts were provided with the knife ridges. These knife ridges are not required in practicing the invention, but they may be a part of the standard machine and need not be removed before retrofitting the machine with a wear plate of the present invention.

Figure 4:
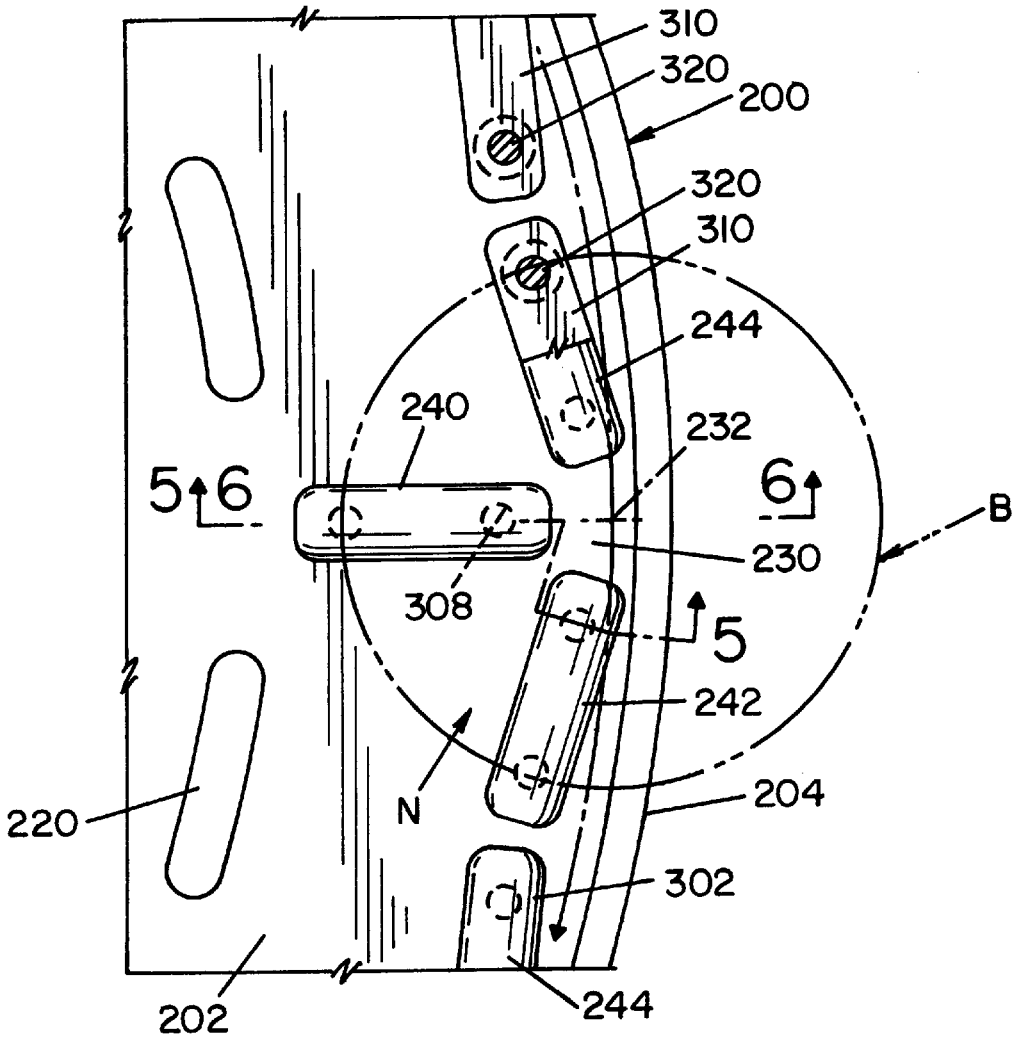
FIG. 4 is a partial top view of the wear plate shown in FIG. 3 illustrating an individual nest on the upper flat surface of the wear plate.
Figure 5:
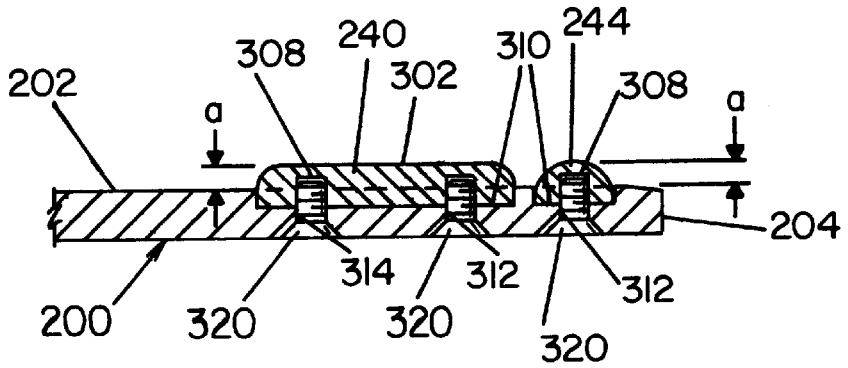
FIG. 5 is a cross-sectional view taken generally along line 5—5 of FIG. 4.
Figure 8:
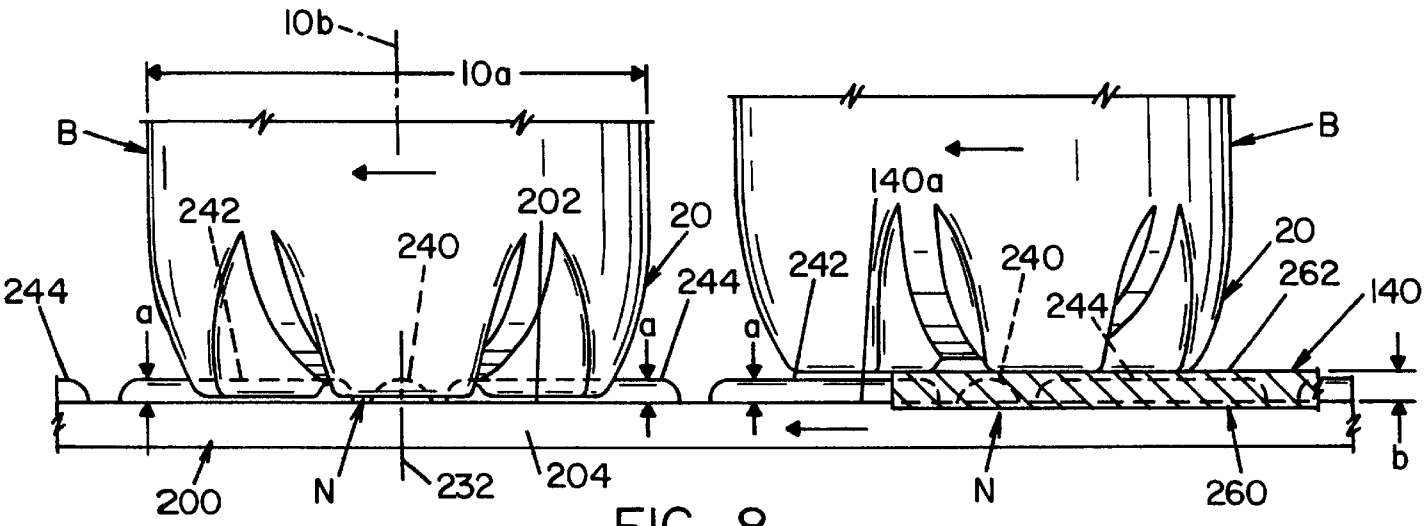
FIG. 8 is a plan view illustrating the inlet conveyor of the preferred embodiment of the present invention.
Figure 9:
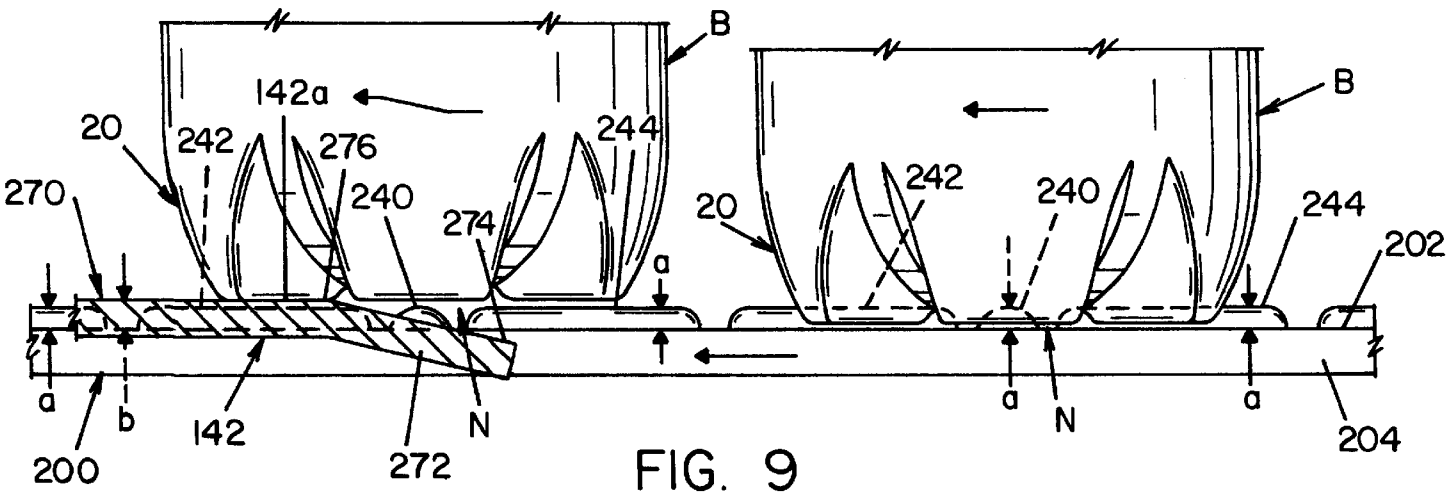
FIG. 9 is a plan view, similar to FIG. 8, illustrating the outlet conveyor used in the preferred embodiment of the present invention; and, FIGS. 10–13 are construction views illustrating the manufacturing and installation of the elongated bar-like abutments used in the preferred embodiment of the present invention.
Figure 10:
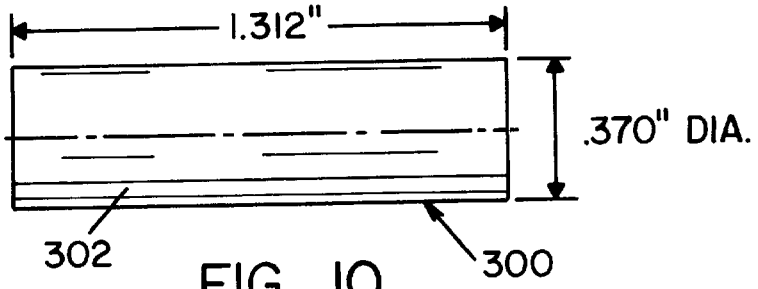
Figure 11:
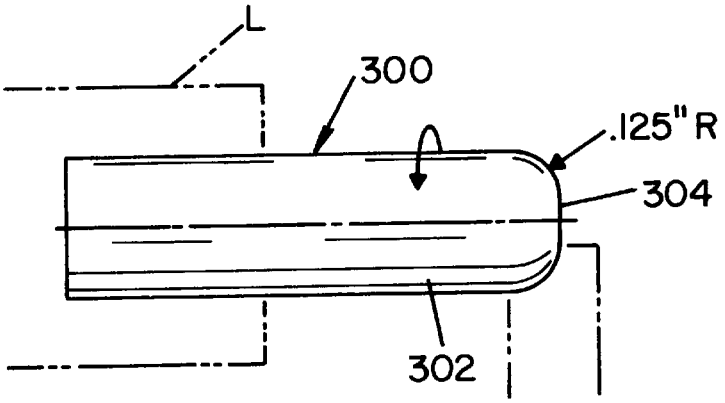
Figure 12:
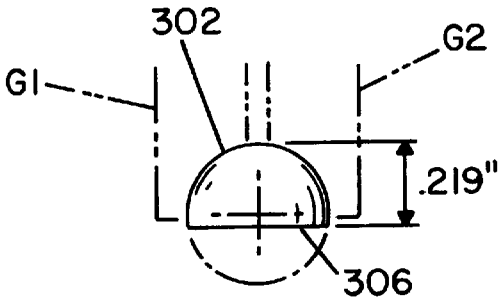
Figure 13:
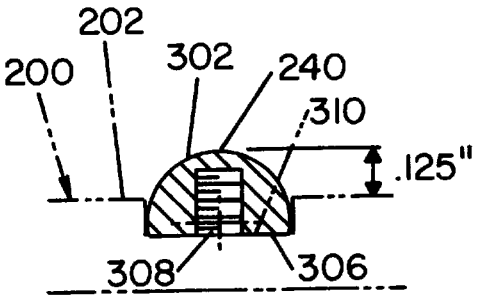

As so far described, capping machine A is standard equipment for use in a filling and capping line of a bottling plant. The difficulty with such equipment is that the capping procedure requires that the bottle remain stationary in a rotary direction to assure final position of the cap C on the threaded neck 12. Bottlers are now insisting upon capping machines which do not depend upon a portion of the pocket 82 digging into the outer surface of the bottle. The present invention accomplishes this objective by providing a series of bottle receiving nests N on a standard wear plate 200 having an upper flat surface 202 and an outer periphery 204, which outer periphery, in the present invention, is reduced in diameter over previous wear plates. Plate 200 is formed from a ring including two interlocked sections 210, 212 having tongues 214 and grooves 216, as best shown in FIG. 3. To fixedly secure the sectioned ring or wear plate 200 onto base 42 of turret 40, sections 210, 212 are provided with a series of arcuate slots 220, some of which receive bolts 222 extending into base 42. In this manner, wear plate 200 is locked onto the turret and rotates in unison with star wheel 50 with nests N being aligned with the capping head 100 and rotates in unison with the heads, which heads are moved downwardly to cap the bottles as the bottles are conveyed between inlet point 140*a* and outlet point 142*a* in a circular path concentric with machine axis x. Each of the individual nests N has an inner area 230 constituting a portion of flat surface 202 and having a center 232 aligned with center 10*b* of bottle B where the bottle rests upon its individual nest N. In accordance with the invention, three bar-like abutments 240, 242 and 244 are manufactured in accordance with the procedure set forth in FIGS. 10–13, and are assembled as shown in FIGS. 4 and 5. The abutments extend radially outward from center 232. Abutment 240 points toward axis x and abutments 242, 244 are spaced from abutment 240 by an angle determined by formula 360°/X, wherein X is the number of pads on pedaloid base 20 of bottle B. Inlet conveyor 140 includes flange engaging tracks 250, 252 for guiding bottle B to inlet point 140*a* of wear plate 200. Bottom plate 260 has an upper surface 262, as best shown in FIG. 8. Abutments 240 242 and 244 have a vertical height a which in practice is approximately 0.125 inches, as shown in FIG. 13. Upper surface 262 has a height b above surface 202. In this manner, as bottles B move along conveyor 140 toward point 140*a*, as shown in FIG. 8, the bottles are above the top of the bar-like abutments 240, 242 and 244. As the bottle B is moved forward, it drops into nest N, as shown at the left of FIG. 8. This deposits the bottle onto plate 200, where it is engaged by the capping head which attempts to rotate bottle B. Thus, the bottle rotates into a position where the rod-like abutments fit into the recesses of base 20. The abutments thereafter prevent rotation of the bottle as the capping procedure is accomplished. In FIG. 9, the bottle removement mechanisim is illustrated. Outlet conveyor 142 removes the capped bottles from wear plate 200 at exit point 142*a* by using a plate 270 having a height b which is above the top of abutments 240, 242 and 244 and generally at the height of plate 260. Ramp 272 has a first end 274 below surface 202 and a second end 276 merging with the top of the plate 270. Consequently, as the capping machine moves bottle B to the left, as shown in FIG. 9, the bottle engage ramp 272 which lifts the bottles from nests N onto the top of plate 270 for exit into the reminder of the capping line in accordance with standard practice. As illustrated in FIG. 1, tracks 280, 282 engage the flange 16 on each bottle to capture the bottles as they are moved away from capping machine A. In accordance with the invention, periphery 204 is substantially inboard of the outermost portion of bottles B as they move along wear plate 200. In practice, the periphery is a circle concentric with machine axis x and spaced outwardly from center 232 of each individual nest N a distance in the range of ¼ to ½ inch. This allows a portion of the base 20 of each bottle to extend outwardly from periphery 204 so bottle can be dropped onto the nest N and lifted from the nest after the capping procedure.

Rod-like abutments 240, 242 and 244 can be produced in accordance with a variety of manufacturing processes and assembled onto plate 200 by various procedures, such as soldering, welding, brazing, adhesive or total machining away a top layer of plate 200 to leave the abutments. In addition, it is possible to use less than three abutments at each nest N. It has been found that the use of three abutments is preferred. The procedure of manufacturing and assembling the rod-like abutments is set forth in FIGS. 4, 5 and 10–13. A rod 300 having a diameter of 0.370 inches for its outer surface 302 is cut to the desired length, indicated to be 1.312 inches in FIG. 10. The bar is formed from various metals; however, in practice the metal is aluminum having a nominal diameter of ⅜ inches. One end of the rod 300 is mounted in the chuck of a lathe L as shown in FIG. 13. Then a generally semi-spherical end 304 is turned on at one end of bar 300. In practice, a radius of 0.125 inches is employed, which does not result in an exactly semi-spherical shape. Surface 302 remains cylindrical. Bar 300 is then reversed in lathe L and a second end 304 is provided at the opposite end of the bar stock. Thereafter, bar 300 is positioned in clamps G1 and G2 of a surface grinder where a flat 306 is ground onto one side of the rod to a depth slightly less than the radius of the bar. This abutment is then provided with holes 308 that are drilled and tapped so the bar-like abutments 240 can be mounted in appropriate slots 310 cut into surface 202 of wear plate 200, as best shown in FIGS. 4 and 5. Holes 312, 314 in plate 200 receiving tapered headed bolts 320 for fixedly securing bar-like elements in slots 310. Various other arrangements could be used for producing and mounting the abutments. The abutments would have a variety of shapes as long as they generally match the recesses in the bottom of bottles B.

Having thus defined the invention, the following is claimed:

1. A wear plate for use in a rotary capping machine used to apply caps onto a series of plastic containers, having a generally cylindrical body with an outer cylindrical periphery with a diameter, an upper threaded neck and a pedaloid base with spaced pads separated by radial recesses extending from a center recess, as said containers are moved along a circular path by a star wheel with outwardly protruding pockets supporting said necks of said containers, said wear plate being a flat ring rotated in unison with said star wheel about a machine axis and adapted to support said containers, said ring having an upwardly facing flat surface and a series of container receiving nests movable in said path as said ring is rotated, each of said nests having an inner area on said flat surface and at least one elongated bar-like abutment fixed relative to and projecting upwardly from said flat surface a given vertical distance and extending in a direction radial of said inner area wherein said flat surface has an outer curved periphery concentric with said path and a point in said inner area of each nest corresponding to the center of a container on said nest, said periphery being spaced from said point of said inner area whereby said containers traveling along said path extend outwardly over said periphery.

2. A wear plate as defined in claim 1 including an outlet conveyor means for directing containers away from said wear plate at an exit end of said path.

3. A wear plate as defined in claim 1 wherein said ring includes two sections and means for holding said sections together into a circular ring.

4. A wear plate as defined in claim 1 including an inlet conveyor means for directing containers toward said wear plate at an entrant end of said path.

5. A wear plate as defined in claim 4 including an outlet conveyor means for directing containers away from said wear plate at an exit end of said path.

6. A wear plate as defined in claim 1 wherein said base has X pads and including a second bar-like abutment projecting upwardly said given vertical distance and extending in a direction radial of said inner area at an angle of 360°/X from said first mentioned abutment.

7. A wear plate as defined in claim 6 including an inlet conveyor means for directing containers toward said wear plate at an entrant end of said path.

8. A wear plate as defined in claim 6 including an outlet conveyor means for directing containers away from said wear plate at an exit end of said path.

9. A wear plate as defined in claim 6 including a third bar-like abutment projecting upwardly said given vertical distance radial of said inner angle and at an angle 360°/X from said first mentioned abutment and at an angle of twice 360°/X from said second abutment.

10. A wear plate as defined in claim 10 including an inlet conveyor means for directing containers toward said wear plate at an entrant end of said path.

11. A wear plate as defined in claim 9 including an outlet conveyor means for directing containers away from said wear plate at an exit end of said path.

12. A wear plate for use in a rotary capping machine used to apply caps onto a series of plastic containers, having a generally cylindrical body with an outer cylindrical periphery with a diameter, an upper threaded neck and a pedaloid base with spaced pads separated by radial recesses extending from a center recess, as said containers are moved along a circular path by a star wheel with outwardly protruding pockets supporting said necks of said containers, said wear plate being a flat ring rotated in unison with said star wheel about a machine axis and adapted to support said containers, said ring having an upwardly facing flat surface and a series of container receiving nests movable in said path as said ring is rotated, each of said nests having an inner area on said flat surface and at least one elongated bar-like abutment fixed relative to and projecting upwardly from said flat surface a given vertical distance and extending in a direction radial of said inner area wherein said bar-like abutment is generally semi-circular in transverse cross-section.

13. A wear plate as defined in claim 12 wherein said bar-like abutment has generally semi-spherical ends.

14. A wear plate for use in a rotary capping machine used to apply caps onto a series of plastic containers, having a generally cylindrical body with an outer cylindrical periphery with a diameter, an upper threaded neck and a pedaloid base with spaced pads separated by radial recesses extending from a center recess, as said containers are moved along a circular path by a star wheel with outwardly protruding pockets supporting said necks of said containers, said wear plate being a flat ring rotated in unison with said star wheel about a machine axis and adapted to support said containers, said ring having an upwardly facing flat surface and a series of container receiving nests movable in said path as said ring is rotated, each of said nests having an inner area on said flat surface and at least one elongated bar-like abutment fixed relative to and projecting upwardly from said flat surface a given vertical distance and extending in a direction radial of said inner area wherein said flat surface includes a slot and said bar-like abutment is secure in said slot.

15. A wear plate as defined in claim 14 wherein said bar-like abutment has generally semi-spherical ends.

16. A wear plate for use in a rotary capping machine used to apply caps onto a series of plastic containers, having a generally cylindrical body with an outer cylindrical periphery with a diameter, an upper threaded neck and a pedaloid base with spaced pads separated by radial recesses extending from a center recess, as said containers are moved along a circular path by a star wheel with outwardly protruding pockets supporting said necks of said containers, said wear plate being a flat ring rotated in unison with said star wheel about a machine axis and adapted to support said containers, said ring having an upwardly facing flat surface and a series of container receiving nests movable in said path as said ring is rotated, each of said nests having an inner area on said flat surface and at least one elongated bar-like abutment fixed relative to and projecting upwardly from said flat surface a given vertical distance and extending in a direction radial of said inner area wherein said bar-like abutment has generally semi-spherical ends.

17. A wear plate for use in a rotary capping machine used to apply caps onto a series of plastic containers, having a generally cylindrical body with an outer cylindrical periphery with a diameter, an upper threaded neck and a pedaloid base with spaced pads separated by radial recesses extending from a center recess, as said containers are moved along a circular path by a star wheel with outwardly protruding pockets supporting said necks of said containers, said wear plate being a flat ring rotated in unison with said star wheel about a machine axis and adapted to support said containers, said ring having an upwardly facing flat surface and a series of container receiving nests movable in said path as said ring is rotated, each of said nests having an inner area on said flat surface and at least one elongated bar-like abutment fixed relative to and projecting upwardly from said flat surface a given vertical distance and extending in a direction radial of said inner area wherein said base has X pads and including a second bar-like abutment and a third bar-like abutment both projecting upwardly said given vertical distance and extending in a direction radial of said inner area at an angle of 360°/X from said first mentioned abutmnent, said third abutment extending at an angle of twice 360°/X from said second abutment, said wear plate further including an inlet conveyor means for directing containers toward said wear plate at an entrant end of said path wherein said inlet conveyor means includes a plate above said flat surface a distance slightly greater than said given vertical distance whereby said containers are dropped on said nests of said rotating wear plate.

18. A wear plate for use in a rotary capping machine used to apply caps onto a series of plastic containers, having a generally cylindrical body with an outer cylindrical periphery with a diameter, an upper threaded neck and a pedaloid base with spaced pads separated by radial recesses extending from a center recess, as said containers are moved along a circular path by a star wheel with outwardly protruding pockets supporting said necks of said containers, said wear plate being a flat ring rotated in unison with said star wheel about a machine axis and adapted to support said containers, said ring having an upwardly facing flat surface and a series of container receiving nests movable in said path as said ring is rotated, each of said nests having an inner area on said flat surface and at least one elongated bar-like abutment fixed relative to and projecting upwardly from said flat surface a given vertical distance and extending in a direction radial of said inner area wherein said base has X pads and including a second bar-like abutment projecting upwardly said given vertical distance and extending in a direction radial of said inner area at an angle of 360°/X from said first mentioned abutment, said wear plate further including an inlet conveyor means for directing containers toward said wear plate at an entrant end of said path wherein said inlet conveyor means includes a plate above said flat surface a distance slightly greater than said given vertical distance whereby said containers are dropped on said nests of said rotating wear plate.

19. A wear plate for use in a rotary capping machine used to apply caps onto a series of plastic containers, having a generally cylindrical body with an outer cylindrical periphery with a diameter, an upper threaded neck and a pedaloid base with spaced pads separated by radial recesses extending from a center recess, as said containers are moved along a circular path by a star wheel with outwardly protruding pockets supporting said necks of said containers, said wear plate being a flat ring rotated in unison with said star wheel about a machine axis and adapted to support said containers, said ring having an upwardly facing flat surface and a series of container receiving nests movable in said path as said ring is rotated, each of said nests having an inner area on said flat surface and at least one elongated bar-like abutment fixed relative to and projecting upwardly from said flat surface a given vertical distance and extending in a direction radial of said inner area, said wear plate further including an inlet conveyor means for directing containers toward said wear plate at an entrant end of said path wherein said inlet conveyor means includes a plate above said flat surface a distance slightly greater than said given vertical distance whereby said containers are dropped on said nests of said rotating wear plate.

20. A wear plate as defined in claim 19 wherein said ring includes two sections and means for holding said sections together into a circular ring.

21. A wear plate as defined in claim 19 including an outlet conveyor means for directing containers away from said wear plate at an exit end of said path.

22. A wear plate as defined in claim 21 wherein said outlet conveyor means includes a ramp adjacent said wear plate and intersecting said containers from the bottom and under said containers with a first end below said flat surface and a second end above said flat surface by a distance greater than said vertical distance whereby said containers are lifted from said nests.

23. A wear plate for use in a rotary capping machine used to apply caps onto a series of plastic containers, having a generally cylindrical body with an outer cylindrical periphery with a diameter, an upper threaded neck and a pedaloid base with spaced pads separated by radial recesses extending from a center recess, as said containers are moved along a circular path by a star wheel with outwardly protruding pockets supporting said necks of said containers, said wear plate being a flat ring rotated in unison with said star wheel about a machine axis and adapted to support said containers, said ring having an upwardly facing flat surface and a series of container receiving nests movable in said path as said ring is rotated, each of said nests having an inner area on said flat surface and at least one elongated bar-like abutment fixed relative to and projecting upwardly from said flat surface a given vertical distance and extending in a direction radial of said inner area wherein said base has X pads and including a second bar-like abutment and a third bar-like abutment both projecting upwardly said given vertical distance and extending in a direction radial of said inner area at an angle of 360°/X from said first mentioned abutment, said third abutment extending at an angle of twice 360°/X from said second abutment, said wear plate further including an outlet conveyor means for directing containers away from said wear plate at an exit end of said path wherein said outlet conveyor means includes a ramp adjacent said wear plate and intersecting said containers from the bottom and under said containers with a first end below said flat surface and a second end above said flat surface by a distance greater than said vertical distance whereby said containers are lifted from said nests.

24. A wear plate for use in a rotary capping machine used to apply caps onto a series of plastic containers, having a generally cylindrical body with an outer cylindrical periphery with a diameter, an upper threaded neck and a pedaloid base with spaced pads separated by radial recesses extending from a center recess, as said containers are moved along a circular path by a star wheel with outwardly protruding pockets supporting said necks of said containers, said wear plate being a flat ring rotated in unison with said star wheel about a machine axis and adapted to support said containers, said ring having an upwardly facing flat surface and a series of container receiving nests movable in said path as said ring is rotated, each of said nests having an inner area on said flat surface and at least one elongated bar-like abutment fixed relative to and projecting upwardly from said flat surface a given vertical distance and extending in a direction radial of said inner area, said wear plate further including an inlet conveyor means for directing containers toward said wear plate at an entrant end of said path and an outlet conveyor means for directing containers away from said wear plate at an exit end of said path wherein said outlet conveyor means includes a ramp adjacent said wear plate and intersecting said containers from the bottom and under said containers with a first end below said flat surface and a second end above said flat surface by a distance greater than said vertical distance whereby said containers are lifted from said nests.

25. A wear plate for use in a rotary capping machine used to apply caps onto a series of plastic containers, having a generally cylindrical body with an outer cylindrical periphery with a diameter, an upper threaded neck and a pedaloid base with spaced pads separated by radial recesses extending from a center recess, as said containers are moved along a circular path by a star wheel with outwardly protruding pockets supporting said necks of said containers, said wear plate being a flat ring rotated in unison with said star wheel about a machine axis and adapted to support said containers, said ring having an upwardly facing flat surface and a series of container receiving nests movable in said path as said ring is rotated, each of said nests having an inner area on said flat surface and at least one elongated bar-like abutment fixed relative to and projecting upwardly from said flat surface a given vertical distance and extending in a direction radial of said inner area wherein said base has X pads and including a second bar-like abutment projecting upwardly said given vertical distance and extending in a direction radial of said inner area at an angle of 360°/X from said first mentioned abutment, said wear plate further including an outlet conveyor means for directing containers away from said wear plate at an exit end of said path wherein said outlet conveyor means includes a ramp adjacent said wear plate and intersecting said containers from the bottom and under said containers with a first end below said flat surface and a second end above said flat surface by a distance greater than said vertical distance whereby said containers are lifted from said nests.

26. A wear plate for use in a rotary capping machine used to apply caps onto a series of plastic containers, having a generally cylindrical body with an outer cylindrical periphery with a diameter, an upper threaded neck and a pedaloid base with spaced pads separated by radial recesses extending from a center recess, as said containers are moved along a circular path by a star wheel with outwardly protruding pockets supporting said necks of said containers, said wear plate being a flat ring rotated in unison with said star wheel about a machine axis and adapted to support said containers, said ring having an upwardly facing flat surface and a series of container receiving nests movable in said path as said ring is rotated, each of said nests having an inner area on said flat surface and at least one elongated bar-like abutment fixed relative to and projecting upwardly from said flat surface a given vertical distance and extending in a direction radial of said inner area, said wear plate further including an outlet conveyor means for directing containers away from said wear plate at an exit end of said path wherein said outlet conveyor means includes a ramp adjacent said wear plate and intersecting said containers from the bottom and under said containers with a first end below said flat surface and a second end above said flat surface by a distance greater than said vertical distance whereby said containers are lifted from said nests.

27. A wear plate for use in a rotary capping machine used to apply caps onto a series of plastic containers, having a generally cylindrical body with an outer cylindrical periphery with a diameter, an upper threaded neck and a pedaloid base with spaced pads separated by radial recesses extending from a center recess, as said containers are moved along a circular path by a star wheel with outwardly protruding pockets supporting said necks of said containers, said wear plate being a flat ring rotated in unison with said star wheel about a machine axis and adapted to support said containers, said ring having an upwardly facing flat surface and a series of container receiving nests movable in said path as said ring is rotated, each of said nests having an inner area on said flat surface and at least one elongated bar-like abutment fixed relative to and projecting upwardly from said flat surface a given vertical distance and extending in a direction radial of said inner area wherein said flat surface of said ring has an outer curved periphery concentric with said path and a point in said inner area of each nest corresponding to the center of a container on said nest, said periphery being spaced from said points of said inner areas of said nests a transverse distance less than ½ inches whereby said containers traveling along said path extend outwardly over said periphery.

28. A wear plate as defined in claim 27 wherein said transverse distance is in the range of ¼–½ inches.

29. A wear plate for use in a rotary capping machine used to apply caps onto a series of plastic containers, having a generally cylindrical body with an outer cylindrical periphery with a diameter, an upper threaded neck and a pedaloid base with spaced pads separated by radial recesses extending from a center recess, as said containers are moved along a circular path by a star wheel with outwardly protruding pockets supporting said necks of said containers, said wear plate being a flat ring rotated in unison with said star wheel about a machine axis and adapted to support said containers, said ring having an upwardly facing flat surface and a series of container receiving nests movable in said path as said ring is rotated, each of said nests having an inner area on said flat surface and at least one elongated bar-like abutment fixed relative to and projecting upwardly from said flat surface a given vertical distance and extending in a direction radial of said inner area wherein said flat surface of said ring has an outer curved periphery concentric with said path and a point in said inner area of each nest corresponding to the center of a container on said nest, said periphery being spaced from said points of said inner areas of said nests a transverse distance less than ½ inches whereby said containers traveling along said path extend outwardly over said periphery, said wear plate further including an inlet conveyor means for directing containers toward said wear plate at an entrant end of said path.

30. A wear plate as defined in claim 29 wherein said transverse distance is in the range of ¼–½ inches.

31. A wear plate for use in a rotary capping machine used to apply caps onto a series of plastic containers, having a generally cylindrical body with an outer cylindrical periphery with a diameter, an upper threaded neck and a pedaloid base with spaced pads separated by radial recesses extending from a center recess, as said containers are moved along a circular path by a star wheel with outwardly protruding pockets supporting said necks of said containers, said wear plate being a flat ring rotated in unison with said star wheel about a machine axis and adapted to support said containers, said ring having an upwardly facing flat surface and a series of container receiving nests movable in said path as said ring is rotated, each of said nests having an inner area on said flat surface and at least one elongated bar-like abutment fixed relative to and projecting upwardly from said flat surface a given vertical distance and extending in a direction radial of said inner area wherein said base has X pads and including a second bar-like abutment projecting upwardly said given vertical distance and extending in a direction radial of said inner area at an angle of 360°/X from said first mentioned abutment and said flat surface of said ring has an outer curved periphery concentric with said path and a point in said inner area of each nest corresponding to the center of a container on said nest, said periphery being spaced from said points of said inner areas of said nests a transverse distance less than ½ inches whereby said containers traveling along said path extend outwardly over said periphery.

32. A wear plate as defined in claim 31 wherein said transverse distance is in the range of ¼–½ inches.

33. A rod-like abutment to be used in a capping machine for capping a plastic bottle having a bottom, said machine having a wear plate to engage the bottom of a plastic bottle to prevent rotation thereof as it is moved in a given path during a capping operation, said abutment comprising an elongated truncated cylindrical element with a flat bottom surface, said bottom surface including means for connecting said element onto said wear plate.

* * * * *